United States Patent [19]

Fujiwara et al.

[11] Patent Number: 5,036,680

[45] Date of Patent: Aug. 6, 1991

[54] REFRIGERATION SEPARATOR WITH MEANS TO METER QUALITY OF REFRIGERANT TO THE EVAPORATOR

[75] Inventors: Kenichi Fujiwara, Kariya; Kazutoshi Nishizawa, Toyoake; Akira Iwashita, Obu, all of Japan

[73] Assignee: Nippondenso Co., Ltd., Kariya, Japan

[21] Appl. No.: 538,336

[22] Filed: Jun. 14, 1990

[30] Foreign Application Priority Data

Jun. 14, 1989 [JP] Japan ..... 1-151283

[51] Int. Cl.[5] ..... F25B 39/04

[52] U.S. Cl. ..... 62/509; 62/224; 62/503

[58] Field of Search ..... 62/509, 224, 503

[56] References Cited

U.S. PATENT DOCUMENTS 4,179,898 12/1979 Vakil ..... 62/509

4,986,082 1/1991 Tomaru ..... 62/509

*Primary Examiner*—Albert J. Makay

*Assistant Examiner*—John Sollecito

*Attorney, Agent, or Firm*—Cushman, Darby & Cushman

[57] ABSTRACT

A refrigeration cycle apparatus includes a compressor, condenser, pressure-reducing device, evaporator, and gas-liquid separator between the pressure-reducing device and the evaporator. The gas-liquid separator separates a coolant from the pressure-reducing device into a liquid coolant and a gas coolant. A conduit between the gas-liquid separator and the evaporator supplies the separated liquid and gas coolant into the evaporator at a predetermined rate for controlling the quality of the coolant downstream of the gas-liquid separator, thereby attaining a super-cool condition of the coolant at the outlet portion of the condenser.

10 Claims, 8 Drawing Sheets

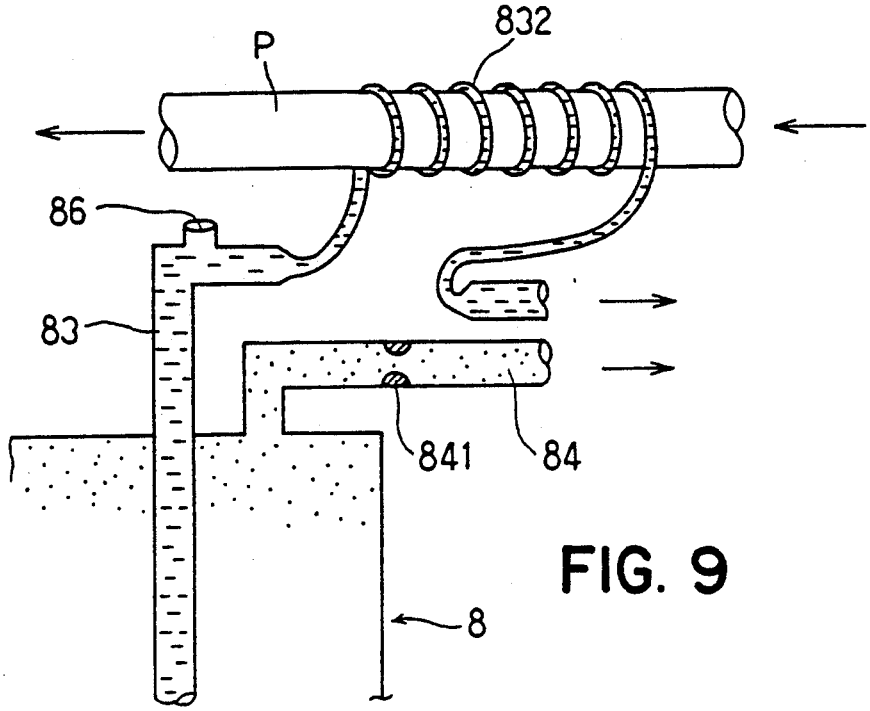
FIG. 9
FIG. 10
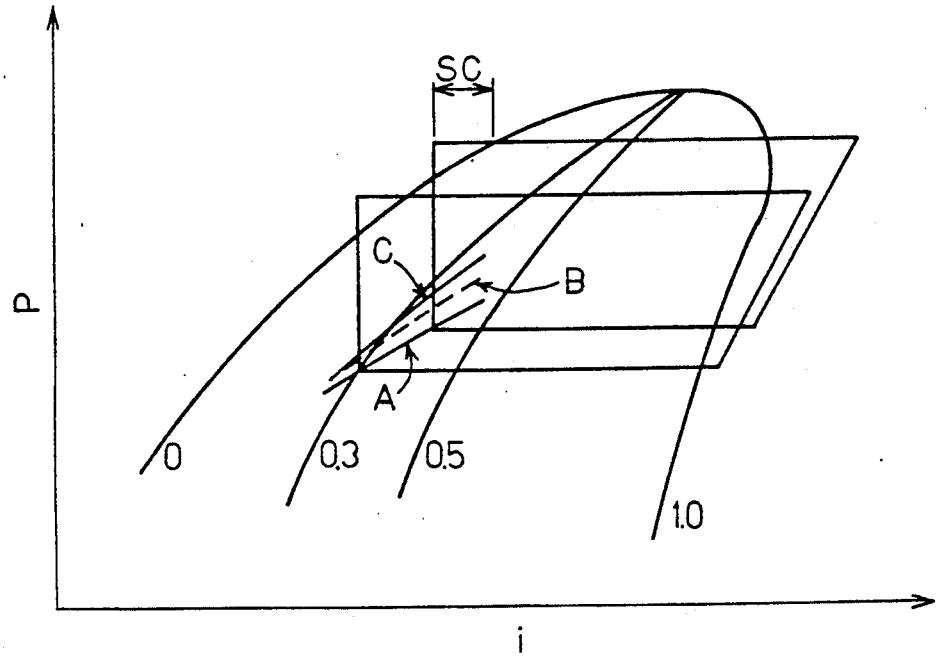

REFRIGERATION SEPARATOR WITH MEANS TO METER QUALITY OF REFRIGERANT TO THE EVAPORATOR

BACKGROUND OF THE INVENTION

1. Field of the invention

The present invention relates to a refrigeration cycle apparatus.

2. Description of Related Art

In a conventional refrigeration cycle apparatus having a gas-liquid separator which separates the liquid coolant from the gas coolant, there are two refrigeration types. One is called a receiver cycle and the other is called an accumulator cycle. FIG. 14 and FIG. 15 are schematic views of the receiver cycle and the accumulator cycle, respectively.

With reference to FIG. 14, an operation of the receiver cycle is explained in the order of a coolant flow. The liquid coolant provided from a receiver 3 is intensively expanded by an expansion valve 4 and introduced into an evaporator 5 as a misty condition of a low temperature and a low pressure. The misty coolant introduced into the evaporator 5 is evaporated to be the a gas coolant of super-heat condition by receiving a latent heat from an atomoshperic air around the surface of the evaporator 5 so as to cool the air while passing through the evaporator 5. Then the gas coolant is sucked into a compressor 1. Such gas coolant is compressed to a high temperature and high pressurized condition and discharged from the compressor 1 to a condenser 2 in which the gas coolant is liquidized. The liquidized coolant flows into a receiver 3. The refrigeration is achieved by repeating the above-mentioned operations.

An operation of the accumulator cycle is explained in the order of a coolant flow by using FIG. 15. The gas coolant is sucked into a compressor 1 and compressed therein to a high temperature and high pressurized condition, and such compressed gas is discharged from the compressor 1. The discharged high-temperature and high-pressure gas is introduced into a condenser 2 and is changed into the liquid coolant because of the forcibly cooling. Such liquid coolant becomes a super-cool condition after the same is passed the condenser 2. The liquid coolant liquidized by the condenser 2 flows into a capillary tube **6*a* of a composite-throttling-device 6. The shape of the capillary tube 6*a* is so small that the pressure of the coolant is reduced. The coolant is rapidly expanded by passing through a nozzle 6*b* so that it becomes a low-temperature and low-pressure misty coolant. The misty coolant flows into an evaporator 5 in which the coolant is evaporated by receiving the latent heat for evaporation from an atmospheric air around the surface of the evaporator 5. Therefore, the air passing through the evaporator 5 is cooled. After such evaporation, the coolant flows into an accumulator 7 in which the coolant is separated into the liquid coolant and the gas coolant so as to transfer only the gas coolant into the compressor 1**. The refrigeration is achieved by repeating the above-mentioned operations.

According to the above-explanation, it is necessary to properly control the coolant condition of the outlet portions of two heat-exchangers, namely, the condenser 2 and the evaporator 5 in the refrigeration cycles for effectively operating the refrigeration cycles.

The difference between the receiver cycle and the accumulator cycle exists in the control method of the coolant condition of the outlet portion of the condenser 2 and the evaporator 5, as shown in FIG. 16. Hereinafter, each control method is explained.

According to the receiver 3 cycle, the receiver controls the coolant condition at the outlet portion of the receiver 3. Namely, since an interface between gas and liquid always exists in the receiver 3 and since only the saturated liquid coolant is sent out from the receiver 3, the coolant at the outlet portion of the condenser 2 always keeps in the saturated liquid condition. In this cycle, the expansion valve 4 controls the coolant condition at the outlet portion of the evaporator 5. Namely, in response to a signal from a heat detector **4*a* located the outlet portion of the evaporator 5, the expansion valve 4 controls the flow rate of the coolant so that the gas coolant of the outlet portion has a constant superheat(SH). Therefore, the gas coolant having a controlled super-heat is constantly sucked into the compressor 1**.

On the other hand, according to the accumulator cycle shown in FIG. 15, the composite throttling device 6 is provided in the upstream of the inlet portion of the evaporator 5 while no receiver is provided in the downstream of the condenser. Although the coolant condition at the outlet portion of the condenser 2 changes, a super-cool(SC) is controlled with a certain degree because a flow characteristic of the composite throttling device 6 is set so that the liquid coolant constantly flows through the composite throttling device 6.

The coolant condition of the outlet portion of the evaporator 5 is controlled by the accumulator 7 in a way that an interface between gas and liquid exists as well as the receiver 3 in the receiver cycle in FIG. 14 and that only a saturated gas coolant is sent out to the compressor. As a result, the coolant of the outlet portion of the evaporator 5 is constantly kept in a saturated gas phase condition.

However, there are problems about the above two types refrigeration cycle apparatus.

In the receiver cycle shown in FIG. 14, there are two following problems. First of all, a high pressure container having a high pressure resistance is necessary for the receiver 3 because it is arranged in the downstream of the condenser 2, which is a high pressure area. In the second, the apparatus does not properly carry out at the start of the refrigeration cycle because the liquid coolant exists in the receiver 3 which is far from the suction portion of the compressor 1 according to the configuration of this cycle.

On the other hand, according to the accumulator cycle shown in FIG. 15 which uses the composite-throttling-device 6, there is a problem that a large-sized tank is necessary for because it separates the gas coolant from the high pressurized liquid coolant. Furthermore, there is a necessity that the contained coolant volume can not be checked by a sight glass provided on the gas-liquid separator such as the receiver 3 in the receiver cycle.

SUMMARY OF THE INVENTION

An object of the present invention is to provide a new refrigeration cycle apparatus which has a gas-liquid separator to properly control a coolant condition at an outlet portion of a heat exchanger for solving the above-mentioned problems and for effectively operating the refrigeration cycle.

The present invention provides a following configuration in order to achieve the above-mentioned object.

A refrigeration cycle apparatus of the present invention includes a compressor, a condenser, a pressure-reducing device, an evaporator, and a gas-liquid separator provided between the pressure-reducing device and the evaporator, wherein the gas-liquid separator separates a coolant from the pressure-reducing device into a liquid coolant and a gas coolant. The apparatus further includes a conduit which is provided between the gas-liquid separator and the evaporator and supply the separated liquid and gas coolant into the evaporator at a predetermined rate so at to control a quality of the coolant in the downstream of the gas-liquid separator.

According to the above configuration, the coolant is compressed by the compressor to a condition of the high temperature and high pressure gas and discharged to the condenser in which the gas coolant is liquidized. Then, the high pressure liquid coolant is changed into the low temperature and low pressure misty coolant, namely, a mixture of the liquid phase and the gas phase is attained when the pressure of the high-pressure liquid-coolant is rapidly reduced by the pressure reducing device. Each of the liquid coolant and the gas coolant is supplied from the gas-liquid separator through the conduit to the evaporator at a predetermined rate. The quality of the liquid coolant and the gas coolant passing through the conduit is controlled by the predetermined rate. Thereafter, the coolant is evaporated in the evaporator by receiving a latent heat for evaporation and is sucked into the compressor.

Because the quality of the coolant downstream of the gas-liquid separator is controlled by the conduit provided between the gas-liquid separator and the evaporator, the coolant condition of the outlet portion of the condenser is controlled in quality. Namely, a super-cool condition of the coolant at the outlet portion of the condenser is attained. Besides the above-mentioned features, a specific high pressure container having a pressure-resistant structure is not necessary because the conduit is provided in a low pressure area which is the downstream of the pressure reducing device.

BRIEF DESCRIPTION OF THE DRAWINGS

FIG. 3 is a schematic view showing a refrigeration cycle, FIG. 4 is a mollier diagram, and FIG. 5 is a partially schematic view of a gas-liquid separator;

FIG. 6 and FIG. 8 are partially schematic views of a gas-liquid separator, and FIG. 7 is a mollier diagram;

FIG. 9 and FIG. 10 show a fourth embodiment of the present invention, FIG. 9 is a schematic view of a gas-liquid separator, and FIG. 10 is a mollier diagram;

DETAILED DESCRIPTION OF THE EMBODIMENTS

Hereinafter, the preferred embodiments of the present invention are described with reference to the drawings.

First embodiment

Figure 1:
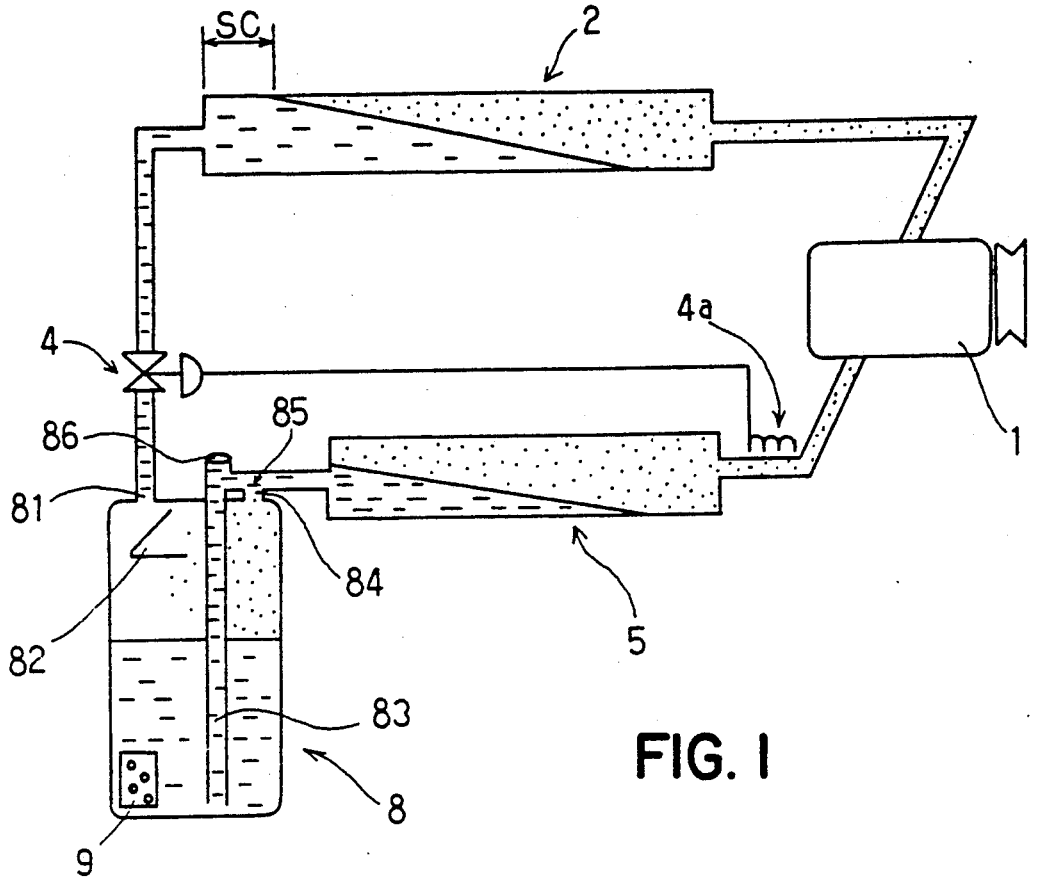
FIG. 1 is a schematic view showing a refrigeration cycle of a first embodiment of the present invention.
Figure 14:
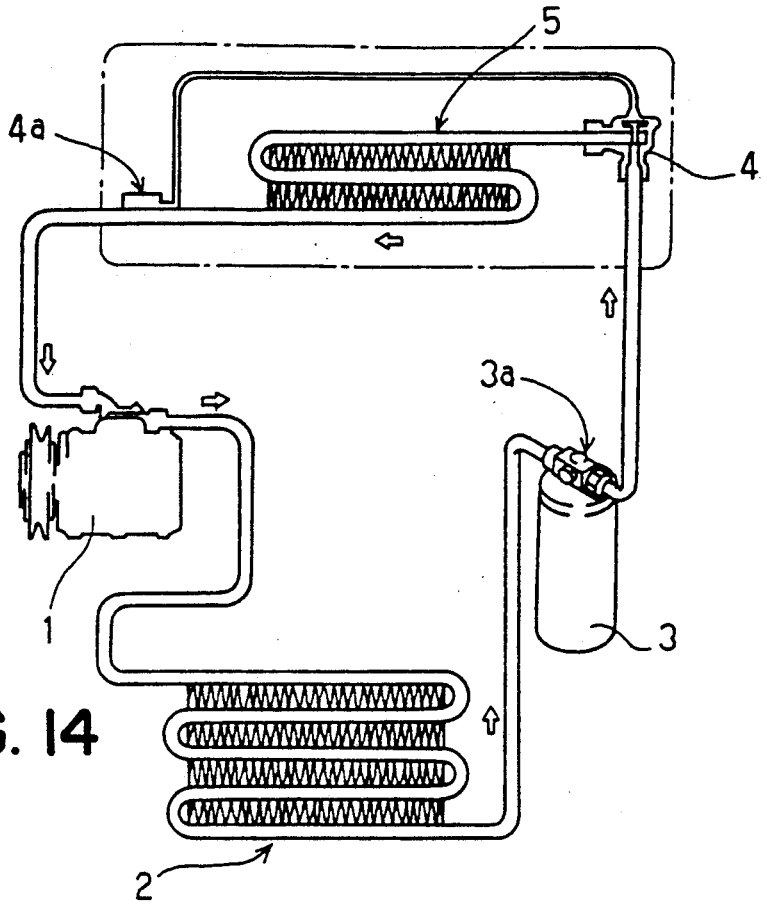
FIG. 14 is a schematic view showing a receiver cycle.
Figure 15:
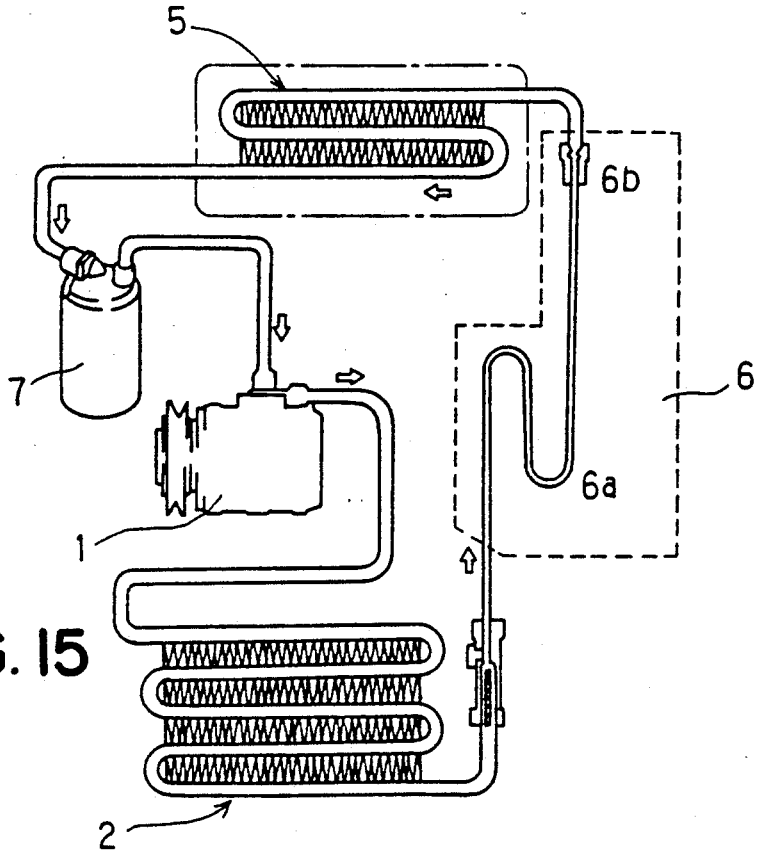
FIG. 15 is a schematic view showing a accumulator cycle.

A refrigeration cycle of a first embodiment of the present invention is shown in FIG. 1. Although the schematic configuration is similar to the receiver cycle shown in FIG. 14, a gas-liquid separator 8 is not provided in the direct downstream of a condenser 2, but provided in the low temperature and low pressure area between an expansion valve 4 and an evaporator 8. Further, the outlet portion of the gas-liquid separator 8 is distinguished from the receiver 3 in the receiver 3 cycle in which the outlet of the receiver is positioned at the bottom thereof so that only a saturated liquid coolant contained within the receiver 3 flows to the expansion valve 4. According to the present embodiment, in addition to such outlet, another outlet for a gas coolant is formed at the upper portion of the gas-liquid separator 8.

In FIG. 1, a gas-liquid separating plate 82 is disposed near an inlet 81 and separates a coolant introduced from the expansion valve 4 into the liquid phase and the gas phase, and therefore an interface between the gas phase and the liquid phase is formed within the gas-liquid separator 8. The saturated liquid coolant near the bottom of the gas-liquid separator 8 is transferred through a liquid-coolant outlet-passage 83 as a first conduit to the evaporator 5, and the saturated gas coolant in the upper portion of the gas liquid separator 83 is transferred through a gas coolant outlet-passage 84 as a second conduit to the evaporator 5. Numeral 85 denotes a junction which mixes the saturated liquid coolant with the saturated gas coolant so as to introduce such mixture into the evaporator 85. A sight glass 86 is provided on an upper portion of the liquid coolant outlet-passage 83 which is located in the upstream of the junction 85. By observing a coolant condition flowing through the liquid coolant outlet-passage 83 through the sight glass 86, a contained coolant volume can be checked. Numeral 9 denotes a dryer for removing water contained in the refrigeration cycle.

Figure 2:
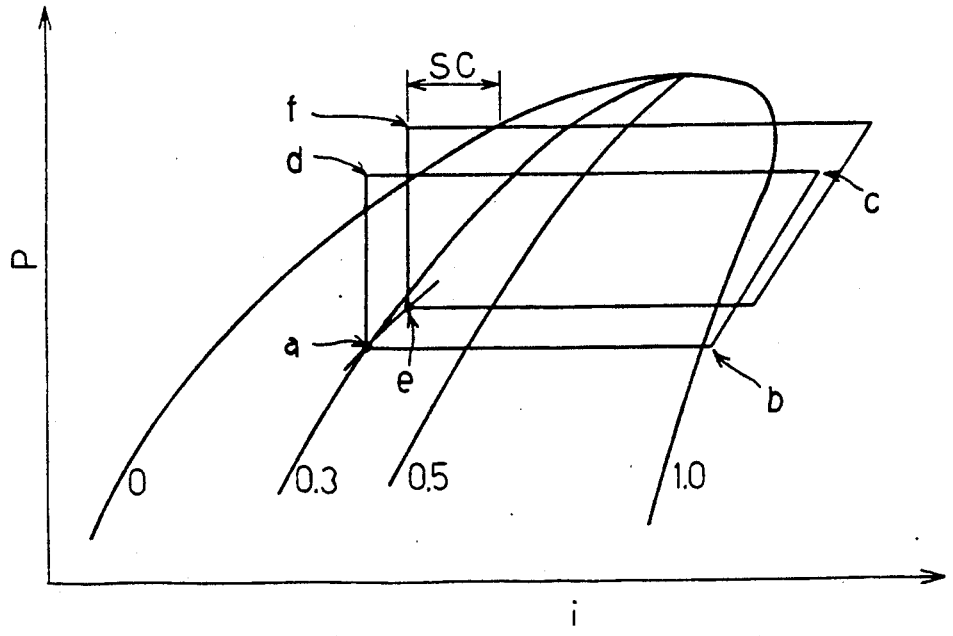
FIG. 2 is a mollier diagram explaining the operation of the apparatus shown in FIG. 1.

Hereinafter, an operation of the present invention is described with reference to a mollier diagram of FIG. 2. In the present embodiment, when R134 is used as a coolant, a passage resistance ratio of the liquid coolant outlet-passage 83 and the gas coolant-outlet passage 84 is determined in a way that a ratio of a weight-flow rate in the liquid coolant outlet-passage 83 to that in the gas coolant-outlet passage 84 is 7:3 when the liquid coolant and the gas coolant flow through the passages 83 and 84 respectively at a pressure of $2Kg/cm^2G$.

After the liquid-gas phase coolant is reduced in the expansion valve 4, the coolant is separated into the gas and the liquid within the gas-liquid separator 8. The saturated liquid coolant and the saturated gas coolant flow out of the outlet 83 near the bottom and the outlet 84 near the upper portion, respectively, and flow into the evaporator 5. In case that the pressure of the coolant is reduced to $2Kg/cm^2G$, the ratio of the coolant weight-flow rate of the liquid to that of the gas is 7:3(quality=0.3) because of the above mentioned passage resistance ratio, and therefore the coolant of the inlet of the evaporator 5 is controlled to a condition shown at the point "a" in FIG. 2. The coolant condition of the outlet of the evaporator 5 is controlled to a condition shown at the point "b" by the expansion valve 4, and the super-heated gas coolant is controlled to be the high temperature and high pressure gas condition shown at the point "c". The coolant condition of the outlet of the condenser 2 is shown at a point "d" because no entholpy changes by the coolant change in the expansion valve 4. Accordingly, the coolant condition of the outlet of the condenser 2 is controlled to a point "d" since the gas-liquid separator 8 controls the coolant condition of the inlet of the evaporator 5.

When using coolant R134a with a flow pressure of $2Kg/cm^2G$ and a high pressure of $15Kg/cm^2G$, the super-cool (SC) of the outlet of the condenser 2 shown at the point "d" is theoretically 10° C. The super-cool changes from 10° C. into 12° C. when the heat exchange at the condenser 2 is promoted, the quality of the two phases coolant flowing into the gas-liquid separator is less than 0.3. Accordingly, as the quality of the coolant flowing out of the expansion valve 4 into the gas-liquid separator 8 is lower than 0.3, the flow rate of liquid coolant in the outlet of the condenser increases. However, as the quality of the coolant flowing out of the gas-liquid separator 8 is maintained to 0.3 by the above-described passage resistance ratio, the volume of the liquid coolant increases in the gas-liquid separator 8. Accordingly, the flow rate of the liquid coolant in the outlet of the condenser 2 reduces so that the super-heat returns to 10° C.

When a cooling load increases in the evaporator 5, the coolant pressure in the low pressure area increases because the evaporating temperature increases in the evaporator 5 and much coolant evaporates therein. In addition to this feature, the coolant pressure in the high pressure area increases, and much gas coolant flows into the condenser 2. In this condition, if the coolant pressure in the low pressure area is higher than before the initial condition e.g. $2Kg/cm^2G$, the specific weight of the liquid coolant reduces. Accordingly, as the weight-flow rate is changed due to the above-described condition, the quality of the coolant in the inlet of the evaporator 5 becomes higher than 0.3, and the coolant condition moves to a point "e" shown in FIG. 2.

When a coolant R134a is used the coolant pressure in the low pressure area and the coolant pressure in the high pressure area are set at $3.5Kg/cm^2G$ and $25Kg/cm^2G$, respectively, under the high load condition, the quality of the coolant in the outlet of the condenser 2 is changed to 0.35. As a result, the coolant condition in the outlet of the condenser 2 moves to a point "f" shown in FIG. 2 so that the liquid coolant in the outlet of the condenser 2 has a super-heat SC(19° C.) when the refrigeration load is increased. A proper super-cool can be maintained and an effective enthalpy difference can be taken in the evaporator 5 even when the refrigeration load is high. Accordingly, the refrigeration power can be effectively maintained.

Second embodiment

Figure 3:
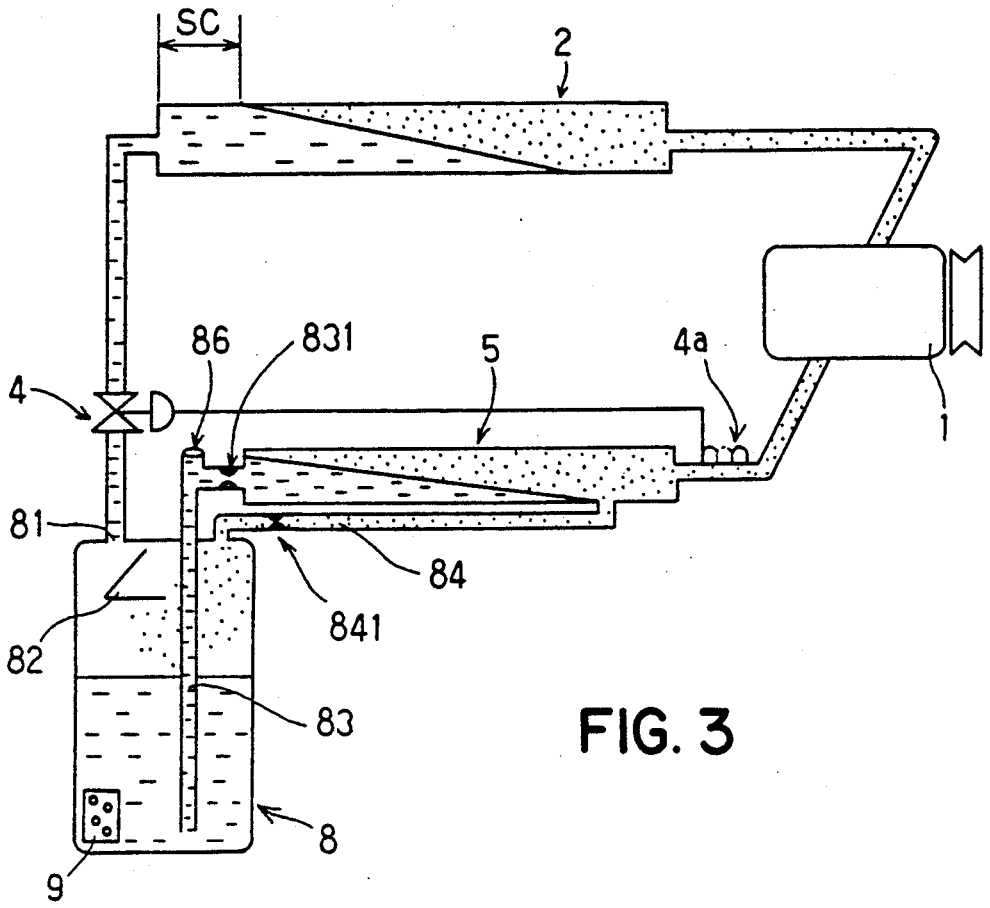
FIG. 3 through FIG. 5 show a second embodiment of the present invention.

In FIG. 3 showing a second embodiment of the present invention, an orifice 831 is provided in the downstream of the sight glass 86 so as to increase the flow resistance of the liquid coolant. For the same reason, an orifice 841 is provided in the gas-coolant outlet passage 84. With reference to the numerals in FIG. 3, each numeral, which is identical with that in the first embodiment shown in FIG. 1, denotes the same element in the configuration shown in FIG. 1.

Considering a decline of compression by the compressor 2 due to the pressure loss in the evaporator 5, the gas coolant in outlet-passage 84 is introduced near the outlet of the evaporator 5 in order to recover such pressure loss in the evaporator 5.

According to the present embodiment, as the orifices 831 and 841, which increase the flow resistance by their pressure loss, are provided, the change of the super-cool SC due to the change of the refrigeration load can be suppressed more effectively.

Because of the presence of orifices 831 and 841, the coolant pressure in the gas-liquid separator 8 is higher than that of the inlet of evaporator 5 by its pressure loss of the orifices 831 and 841. In this case, the coolant condition in the gas-liquid separator 8 is shown as the point "a'" in the mollier diagram of FIG. 4.

Figure 4:
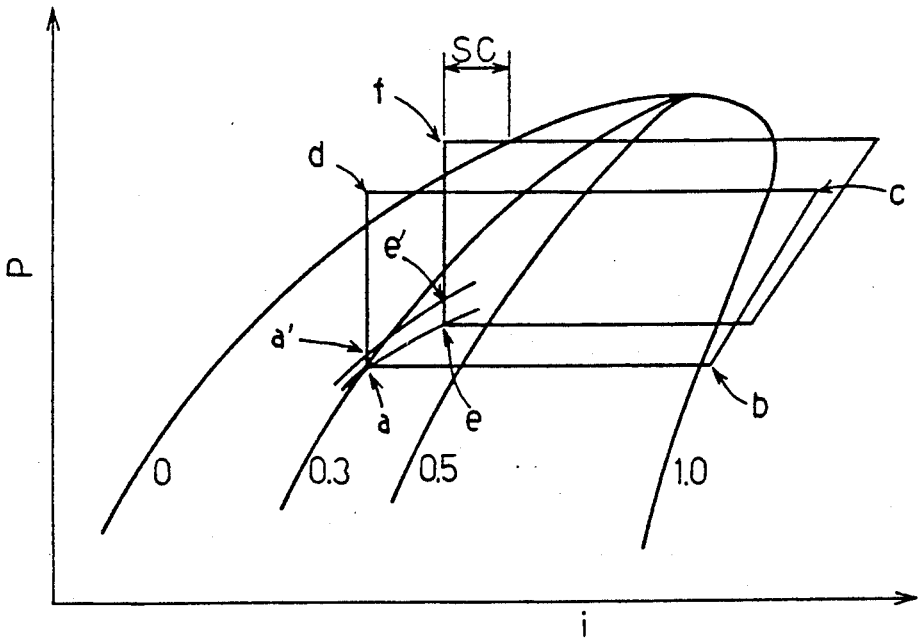

An operation of the present refrigeration cycle under the high refrigeration load is explained in detail hereinafter. The coolant quality at high load condition is higher than that at the low load condition so that the specific weight of the gas coolant increases as described above. Further, the evaporation (the foam is generated within the liquid coolant) is promoted because the coolant pressure in the liquid coolant outlet passage 83 is reduced due to the pressure loss by the orifices 831 and 841. Namely, the flow rate of the liquid coolant flowing into the evaporator 5 is reduced due to the pressure loss, and therefore the coolant quality further increases. The coolant condition of the inlet of the evaporator 5 is shown as the point "e" in the mollier diagram of FIG. 4 and the coolant condition in the gas-liquid separator 8 is shown as the point "e'" in FIG. 4. With reference to FIG. 4, the degree of the increment (from point a to point e) of the coolant condition of the evaporator inlet due to the change of the refrigeration load is decreased because the coolant quality is increased due to the orifices 831 and 841. Accordingly, the change of the super-cool SC of the coolant condition (point "d" and point "f" in FIG. 4) of the outlet of the condenser 2 can be suppressed regardless of the change of the refrigeration load.

As the change of the super-cool SH can be suppress within small degree, both an extraordinary rise of high pressure of coolant due to a rise of the super-cool SC and an occurrence of the coolant foam due to a decrease of the super-cool SC can be prevented.

Figure 5:
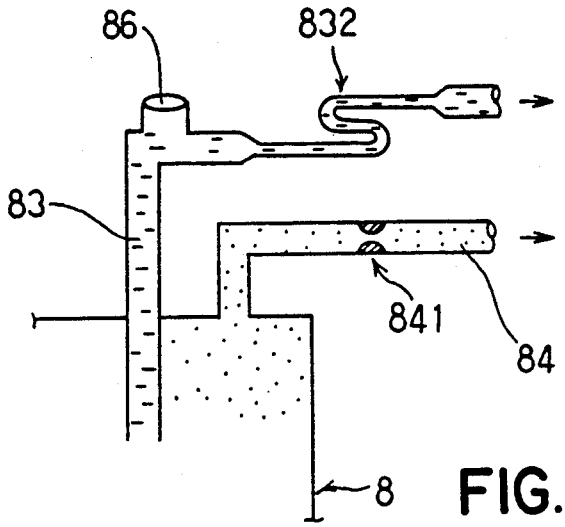

In the above-described embodiment shown in FIG. 3, the pressure loss can be obtained by the orifice. In stead of it, a capillary tube can be used. FIG. 5 shows a partially schematic view of the coolant outlet-passage portion of the gas-liquid separator 8 using a capillary tube 832. In FIG. 5, as the pressure of the saturated liquid coolant in the gas-liquid separator 8 is reduced by a resistance of the capillary tube 832, and the saturated liquid coolant is evaporated. Namely, as explained in the embodiment using orifices 831 and 841, the coolant quality at the evaporator inlet becomes higher when the refrigerant load is high, because the flow rate of the gas coolant flowing into the evaporator 5 is increased and the specific weight of the gas coolant is also increased at the high load condition. Therefore, according to this embodiment, the change of the super heat SC due to the change of refrigeration load can be suppressed within a small degree as well as the embodiment shown in FIG. 3.

Third embodiment

Figure 6:
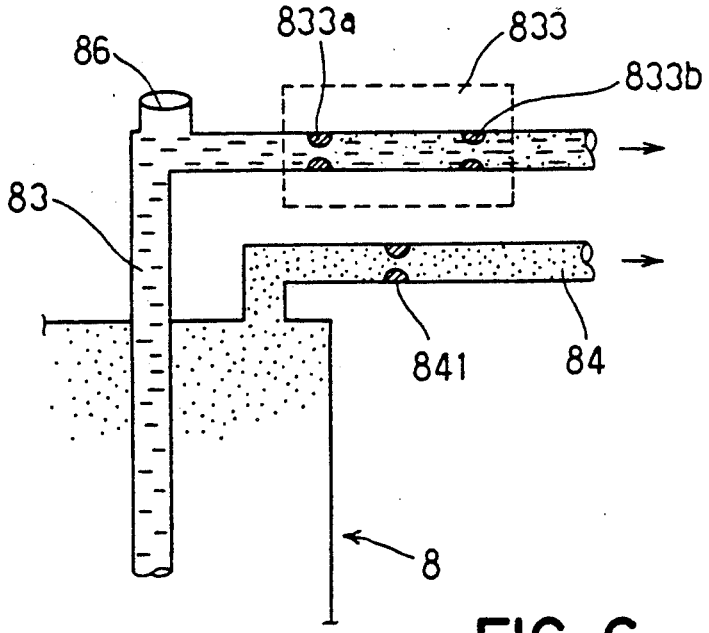
FIG. 6 through FIG. 8 show a third embodiment of the present invention.

In stead of the orifices 831 and 841 or the capillary tube 832 as a means for adding the pressure loss as described in the second embodiment, a composite throttling device 833 can be applied. In FIG. 6, the composite throttling device 833 comprises two orifices 833*a* and 833*b* in the liquid coolant outlet passage 83. The other elements are the same as those of the second element, and the same numeral denotes the same elements of the configuration.

Figure 7:
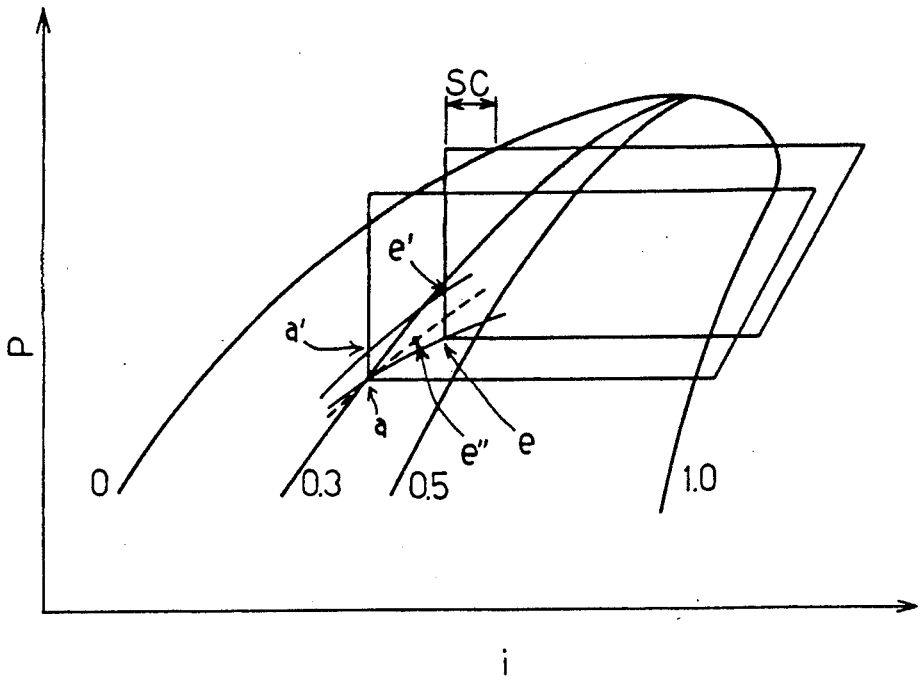

Hereinafter, the operation of the third embodiment is explained with reference to FIG. 7. As the pressure of the saturated liquid coolant is reduced by the pressure loss of the first orifice 833*a* of the composite throttling device 833 formed in the liquid coolant outlet-passage 83, the evaporation of the saturated liquid coolant is promoted. Then, as such coolant in a condition that the foam generated in the liquid is increased the volume thereof, the flow resistance is also increased when the coolant flows through the orifice 833*b*. Namely, in case of a high load condition that a specific weight of gas coolant and a rate thereof are increased, the more pressure loss can be obtained by the composite throttling device 833 compared with that of the second embodiment. Therefore, the coolant quality of the evaporator-inlet under the high load condition is higher than that of the second embodiment. As shown in FIG. 7, the change degree of the coolant condition of the evaporator-inlet due to the change of the refrigeration load is lower than that of the second embodiment (shown in FIG. 4), and the change of the coolant condition of the condenser-outlet, namely the super-cool SC, can be suppressed within a smaller degree. In FIG. 7, the points "a" and "a'" respectively show the coolant condition of the evaporator-inlet and the coolant condition in the gas-liquid separator, under the high load condition. The point "e" denotes the coolant condition of the evaporator-inlet under the high load condition in the second embodiment.

Figure 8:
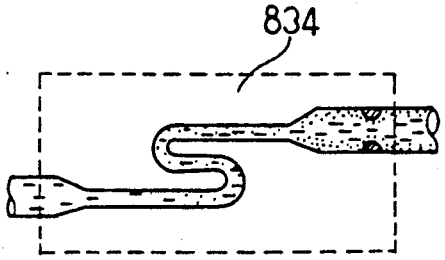

As far as the third embodiment shown in FIG. 6 is concerned, the composite throttling device 833 includes the two serial orifices. However, a device 834 can be composed of a capillary tube and a orifice shown in FIG. 8.

Forth embodiment

With regard to a means for adding a pressure loss, the orifice or the capillary tube is applied in the second and third embodiments as described above. However, the other configuration can be applied as shown in FIG. 9. According to FIG. 9, a capillary tube 832, which is the same shape as that used in the second embodiment, is wound around the coolant conduit P provided between the evaporator 5 and the compressor 1. By this structure, the liquid coolant flowing through the capillary tube 832 receives the heat, which is generated due to the super-heat SH, from the conduit P. When such heat is increased, the evaporation in the capillary tube 832 is intensively occurred so that the coolant quality is also increased. Therefore, the pressure loss becomes higher than that of the embodiment using only the capillary tube 832.

On the other hand, when the super-heat decreases (namely the flow rate of the coolant decreases), the evaporation of the coolant is reduced in the capillary tube 832 because it is hard for the liquid coolant flowing through the capillary tube 832 to receive the heat from the conduit P. Therefore, the pressure loss is about the same as that of the capillary tube.

In FIG. 10 showing the pressure-entholpy characteristic in this embodiment, the line A indicates the change of coolant condition of the evaporator-inlet due to the change of the refrigeration load, the line B indicates the change of the coolant condition in the gas-liquid separator when the capillary tube 832 is not wound around the conduit P, and the line C indicates the change of the coolant condition in the gas-liquid separator in this embodiment.

According to this embodiment, because the degree of the pressure loss added in accordance with the change of the refrigeration load is changed in response to the super-heat SH, the substantially same effect as the composite throttling devices 833 and 834 in the third embodiment can be obtained.

Regarding the above second, third, and fourth embodiments, since the change of the super-cool SC can be suppressed by adding the pressure loss, the extraordinary-pressure-rise in the high pressure area due to the extraordinary increase of the super heat at the high refrigeration load condition or at the high rotation of the compressor can be prevented. Therefore, the above described embodiments can be applied to a refrigeration cycle apparatus such as an automotive air-conditioner which is used in severe conditions that the refrigeration load and the environment condition are changed frequently.

Figure 11:
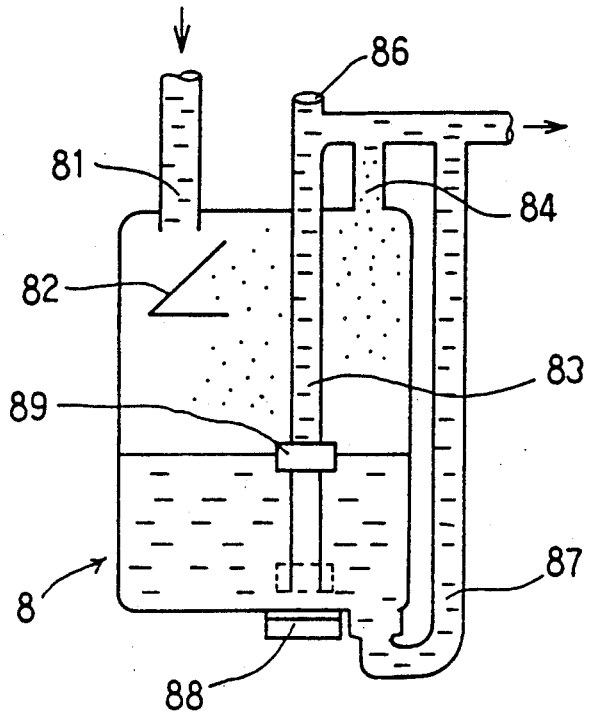
FIG. 11 is a schematic view showing a gas-liquid separator which illustrates a condition of a coolant insufficiency detection.
Figure 16:
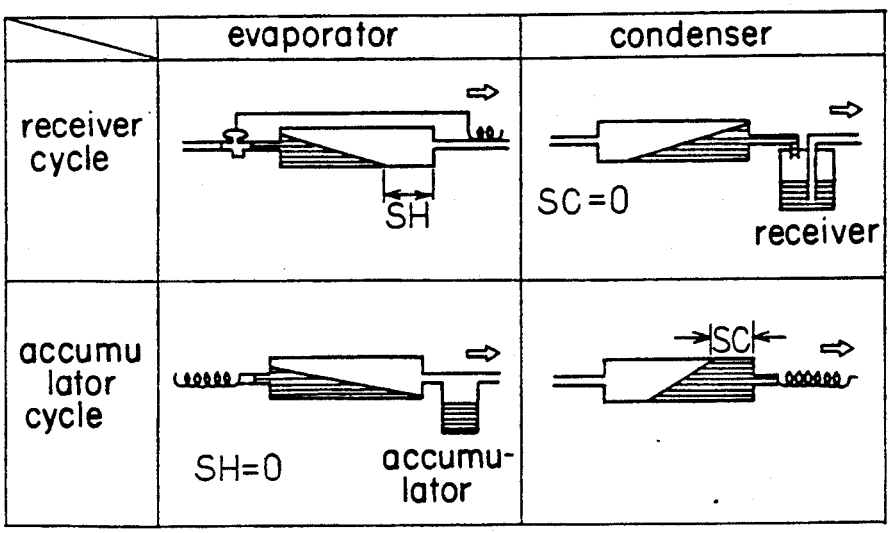
FIG. 16 is a diagram showing a coolant control of the outlet portion of a heat exchanger.

According to the above-described various embodiments, although the sight glass is provided for detecting insufficiency of the coolant, the other structure shown in FIG. 11 can be applied for such detection. In FIG. 11, a numeral 87 denotes a liquid-coolant bypass passage branched from the bottom of the gas-liquid separator 8. A numeral 88 denotes a lead switch. A numeral 89 denotes a magnet-float. Other numerals denotes the same elements shown by the same numerals of FIG. 1.

When the flow rate of coolant is adequate, the gas-coolant outlet-passage 84 becomes a passage for the gas coolant and the liquid-coolant outlet passage 83 becomes a passage for liquid-coolant, and then the quality of coolant of the evaporator-inlet is controlled as described above.

When the flow rate of the coolant is insufficient, the gas coolant flows into the liquid coolant outlet passage 83. Then, as the level of the interface between the gas and the liquid in the gas-liquid separator 8 is decreased, the magnet-float 89 is lowered to a position shown by a broken-line. When such insufficiency is occurred, the gas coolant flows into the bypass passage 87, and the magnet-float 89 contacts with the bottom of the gas-liquid separator 8. In this case, since the lead switch 88 is provided on the outer surface of the gas-liquid separator 8, the lead switch 88 turns off a magnet clutch of a compressor 2 when the magnet-float 89 is approached the lead switch 88.

Accordingly, when the liquid surface in the gas-liquid separator 8 is lowered and the bypass passage 87 is turned into the gas passage, the insufficiency of coolant is detected. Considering the fact that the quality increases when the volume of the coolant is insufficient, the passages 83, 84 and 87 should be designed so that the ratio of the flow rate and the weight of the passages 83, 84 and 87 are 3:3:4 respectively in order to detect the insufficiency of coolant at the quality of 0.6.

Figure 12:
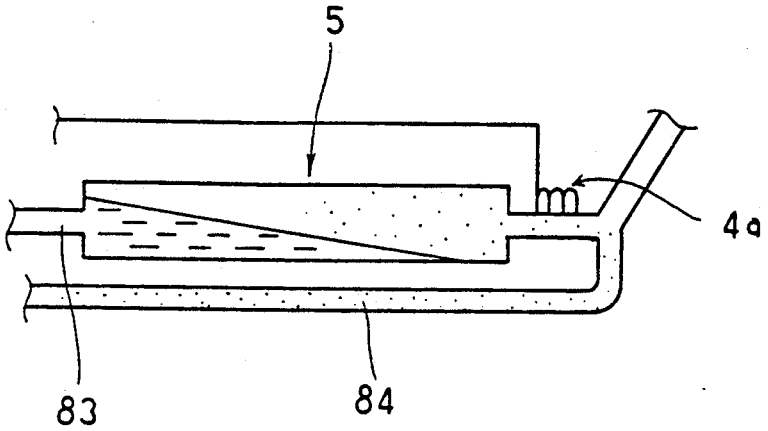
FIG. 12 is a schematic view showing another embodiment of a conduit 84.
Figure 13:
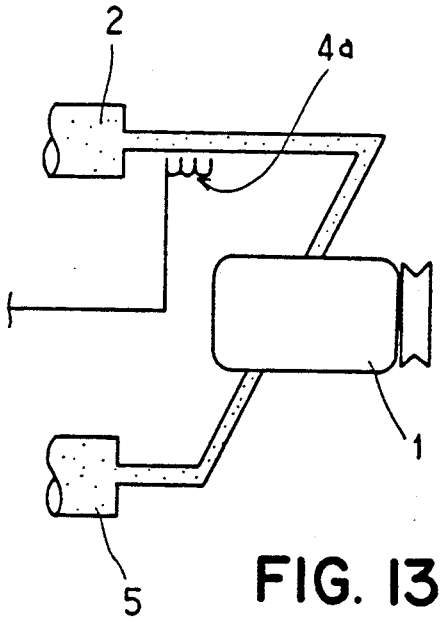
FIG. 13 is a schematic view showing another embodiment of a heat detector 4*a;*

Although the gas-coolant outlet-passage 84 is connected near the outlet of the evaporator 5 in the second embodiment shown in FIG. 3, the gas-coolant outlet-passage 84 can be connected to the downstream of the heat detector 4a provided on a suction conduit of the compressor 1, or directly connected to the suction port of the compressor 1 as shown in FIG. 12. According to this alternation, the super-heat of the coolant sucked into the compressor 1 is lower than that of the coolant of the outlet of the evaporator 5, which is controlled by the heat detector 4a. As a result, the liquid coolant in the evaporator 5 is increased and therefore the refrigeration ability is increased.

Further, although the heat detector 4a provided at the outlet of the evaporator 5 outputs a signal, corresponding to a coolant temperature of the evaporator-outlet, to the expansion valve 4 as shown in FIG. 1 and FIG. 3, it can be provided between the discharge side of the compressor 1 and the inlet of the condenser 2. According to this alternation, the response of the signal output from the heat detector 4a to the expansion valve can be improved. In addition to this characteristic, in case of using it in a refrigeration apparatus for the car air conditioner, the heat detector 4a can be disposed in a front area of a car together with high pressure parts such as the condenser so that the installation and exchange operation of the apparatus can be improved.

The expansion valve 4 is not limited to a mechanically operated type described in the above described embodiments and the other alternations such as a electrically operated type can be used.

We claim:

1. A refrigeration cycle apparatus comprising:

a compressor for compressing a gas coolant to a high temperature and high pressurized condition;

a condenser downstream of said compressor for changing said gas coolant to a high temperature and high pressurized liquid coolant;

a pressure reducing device downstream of said condenser for reducing the pressure of said high temperature and high pressurized liquid coolant;

an evaporator downstream of said pressure-reducing device for evaporating said pressure-reduced coolant;

a gas-liquid separator between said pressure-reducing device and said evaporator for separating the coolant downstream of said pressure-reducing device into a liquid coolant and gas coolant; and conduit means between said gas-liquid separator and said evaporator for supplying the liquid coolant and the gas coolant separated by said gas-liquid separator to said evaporator at a predetermined rate so as to control a coolant quality downstream of said gas-liquid separator.

2. A refrigerant cycle apparatus according to claim 1, wherein said conduit means includes a first conduit for discharging the liquid coolant, a second conduit for discharging the gas coolant and means for determining said predetermined rate due to a flow rate ratio of the liquid coolant and the gas coolant in accordance with flow rate resistances in said first and second conduits.

3. A refrigerant cycle apparatus according to claim 2, wherein said second conduit is connected at a predetermined position downstream of said evaporator.

4. A refrigerant cycle apparatus according to claim 2, wherein said second conduit is connected with a coolant conduit provided between said evaporator and said compressor.

5. A refrigerant apparatus according to claim 2, wherein said first conduit includes pressure-loss means having two serial orifices for adding a pressure-loss in the liquid coolant flowing into said evaporator.

6. A refrigeration apparatus according to claim 2, wherein said first conduit includes pressure-loss means for adding a pressure-loss in the liquid coolant flowing into said evaporator and for changing said pressure-loss in response to a degree of a super-heat of the coolant at an outlet of said evaporators.

7. A refrigeration apparatus according to claim 1, wherein said pressure reducing means includes an expansion valve which controls a flow rate of the coolant flowing therethrough in response to a coolant temperature in a discharge side of said compressor.

8. A refrigeration cycle apparatus comprising:

a compressor for compressing a gas coolant to a high temperature and high pressurized condition;

a condenser downstream of said compressor for changing said gas coolant to a high temperature and high pressurized liquid coolant;

a pressure-reducing device downstream of said condenser for reducing the pressure of said high temperature and high pressurized liquid coolant;

an evaporator downstream of said pressure-reducing device for evaporating said pressure-reducing coolant;

gas-liquid separating means for separating the coolant downstream of said pressure-reducing device into a liquid coolant and a gas coolant; and coolant quality control means for supplying the liquid coolant and the gas coolant separator by said gas-liquid separating means to said evaporator at a predetermined rate so as to control a coolant quality.

9. A refrigeration cycle apparatus according to claim 8, wherein said coolant quality control means includes flow-rate determination means for determining the flow rate of the liquid coolant and the gas coolant separated by said gas-liquid separating means so that a ratio of the flow rate of the liquid coolant to that of the gas coolant is substantially 7:3.

10. A refrigeration cycle apparatus according to claim 9, wherein said flow-rate determination means includes pressure-loss means for adding a pressure-loss in the liquid and the gas coolant.

* * * * *